United States Patent [19]

Hunt et al.

[11] Patent Number: 4,574,916

[45] Date of Patent: Mar. 11, 1986

[54] STEP TO SAFETY

[76] Inventors: John T. Hunt; George Spector, both of 233 Broadway RM 3615, New York, N.Y. 10007

[21] Appl. No.: 748,162

[22] Filed: Jun. 24, 1985

[51] Int. Cl.[4] ..... E06C 5/34

[52] U.S. Cl. ..... 182/18; 182/90; 182/106; 182/113; 340/668; 200/161

[58] Field of Search ..... 182/18, 90, 93, 113, 182/129; 340/668, 541; 200/79, 153 F, 161

[56] References Cited

U.S. PATENT DOCUMENTS

| | | | |
|---|---|---|---|
| 267,504 | 11/1882 | Dunn | 182/18 |
| 381,656 | 4/1888 | Thompson | 182/18 |
| 849,651 | 4/1907 | Ashford | 340/541 |
| 968,520 | 8/1910 | Bailey | 200/161 |
| 1,141,716 | 6/1915 | Kjellstrom | 182/18 |
| 1,639,210 | 8/1927 | Brown | 182/90 |
| 3,298,012 | 1/1967 | Weller | 182/18 |
| 3,696,372 | 10/1972 | Lawrence | 182/18 |

*Primary Examiner*—Reinaldo P. Machado

[57] ABSTRACT

A safety step fire escape is provided and consists of a plurality of steps mounted in a vertical spaced relationship to an outside wall of a building adjacent windows of the building. The last step is elevated high enough from ground level so that a person can only climb down the fire escape. A descent cable extends through the steps to guide the person down the fire escape. A signaling device is operable by movement of the descent cable from its normal position.

7 Claims, 6 Drawing Figures

STEP TO SAFETY

BACKGROUND OF THE INVENTION

The instant invention relates generally to warning devices and more specifically it relates to a safety step fire escape.

Numerous warning devices have been provided in prior art that are adapted to indicate the presence of someone on a ladder. For example, U.S. Pat. Nos. 3,298,012; 3,696,372 and 4,311,208 all are illustrative of such prior art. While these units may be suitable for the particular purpose to which they address, they would not be as suitable for the purpose of the present invention as heretofore described.

SUMMARY OF THE INVENTION

A principle object of the present invention is to provide a safety step fire escape that includes a plurality, of L-shaped steps that are mounted to the outside wall of a building adjacent windows.

Another object is to provide a safety step fire escape that has an alarm which can be activated when someone on the fire escape or inside of a building pulls on a descent cable.

An additional object is to provide a safety step fire escape that includes each step having a removable adjustable railing to increase safety for person using the fire escape.

A further object is to provide a safety step fire escape that is economical in cost to manufacture.

A still further object is to provide a safety step fire escape that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
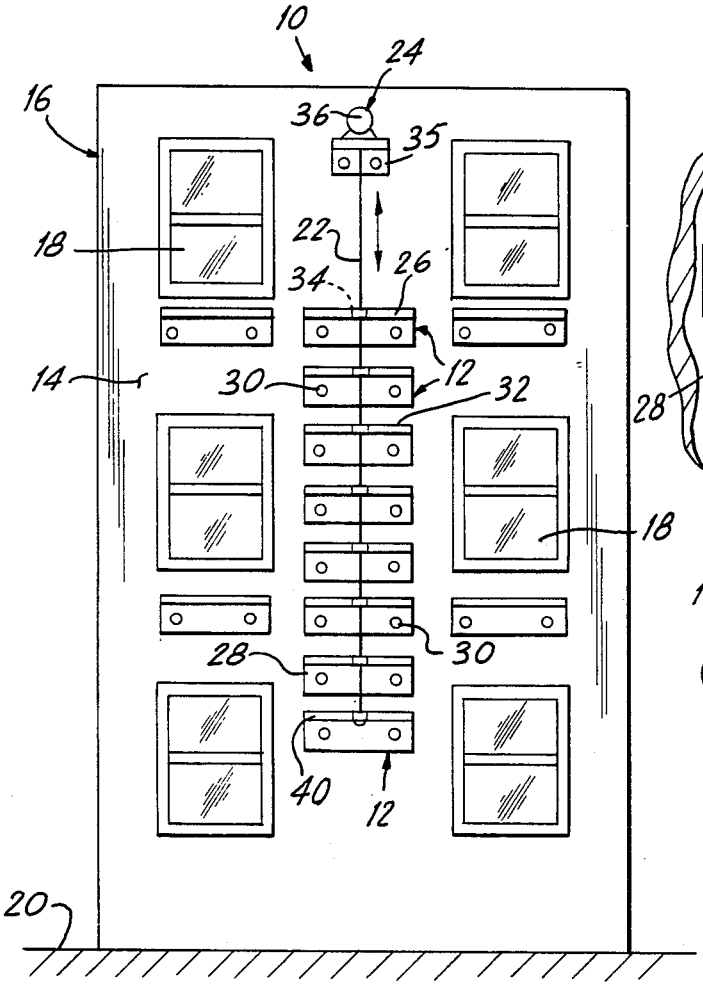
FIG. 1 is a front elevational view of a building with the invention installed on the outside wall whereby moving of descent rope actuates an alarm.

Turning now descriptively to the drawings, in which similar reference characters denote similar elements throughout the several views, FIG. 1 illustrates a safety step fire escape 10 which includes a plurality of steps 12 mounted in a vertical spaced relationship to an outside wall 14 of a building 16 adjacent windows 18 of the building. The bottom step 12 is elevated high enough from ground level 20 so that a person (not shown) can only climb down the fire escape 10.

A descent cable 22 extends through the steps 12 to guide the person down the fire escape 10. A signaling device 24 mounted to the outside wall 14 above the steps 12 is operable by movement of the descent cable 22 from its normal position.

Each step 12 is in an L-shaped configuration and has a large leg 26 and a small leg 28. The small leg is mounted to the outside wall of the building 16 with two galvanized lag bolts 30 driven into building studs. Each large leg 26 of each step 12 includes a non-skid surface 32 and has an aperture 34 so that the descent cable 22 can pass therethrough.

Figure 2:
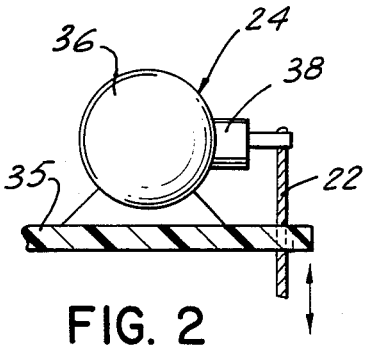
FIG. 2 is a diagrammatic view of the signaling device.

The signaling device 24 as best shown in FIG. 2, is mounted to the outside wall 14 by a bracket 35. It includes an audible alarm 36 and a normally opened switch 38 that is electrically connected to the alarm. The switch 38 is activated by a pull on the descent cable 22 by any person that is either on the fire escape 10 or in any one of the windows 18.

Figure 3:
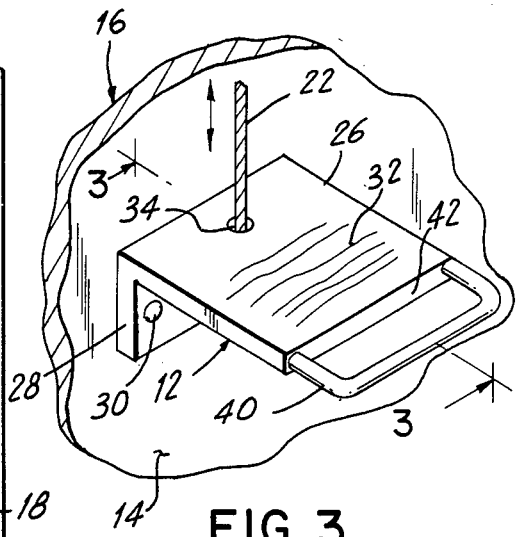
FIG. 3 is an enlarged perspective view of the bottom step with drop bar, mounted on the wall as shown in FIG. 1.
Figure 4:
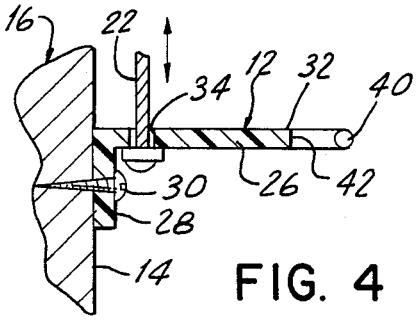
FIG. 4 is a cross sectional view taken along line 4—4 in FIG. 3.

FIGS. 3 and 4 show a C-shaped bar 40 mounted to end 42 of the large leg 26 of the bottom step 12 so that any person on the fire escape 10 can grasp the bar 40 and drop down to the ground level 20 below.

Figure 5:
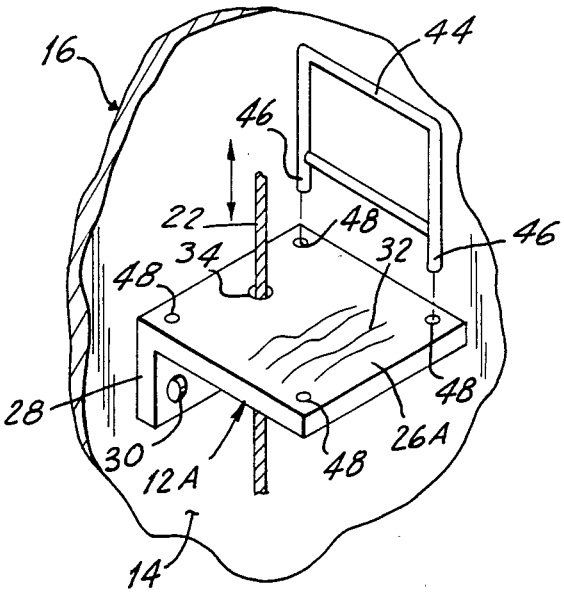
FIG. 5 is an enlarged perspective view similar to FIG. 3 showing a modified step with a removable adjustable railing exploded therefrom.
Figure 6:
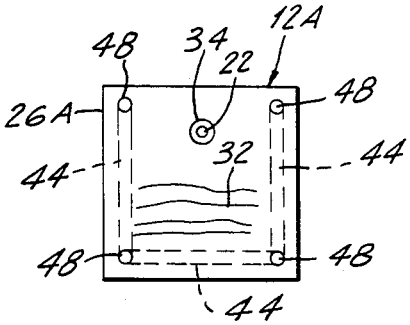
FIG. 6 is a top plan view of the step of FIG. 5 showing various positions the railing can be placed thereon.

FIGS. 5 and 6 show a modified step 12A. A removable adjustable railing 44 is provided and has two posts 46 that fit into any two of the four holes 48 on the large leg 26A. This allows the railing 44 to be placed on any free edge of the large leg 26A as shown in dotted in FIG. 6 to increase safety for any person using the fire escape.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A safety step fire escape which comprises:

(a) a plurality of steps mounted in a vertical spaced relationship to an outside wall of a building adjacent windows of said building whereby said bottom step is elevated high enough from ground level so that a person can only climb down said fire escape;

(b) a descent cable extending through said steps to guide said person down said fire escape; and (c) means for signaling, operable by movement of said descent cable from its normal position.

2. A safety step fire escape as recited in claim 1, wherein each said step is in an L-shaped configuration having a large leg and a small leg with said small leg mounted to said outside wall of said building.

3. A safety step fire escape as recited in claim 2, wherein each said small leg of each said step is mounted to said outside wall of said building with two galvanized lag bolts driven into building studs.

4. A safety step fire escape as recited in claim 3, wherein each said large leg of each said step includes a non-skid surface and having an aperture so that said descent cable can pass therethrough.

5. A safety step fire escape as recited in claim 4, wherein said signaling means includes an audible alarm and a normally opened switch that is electrically connected to said alarm, said switch activated by pull on said descent cable by said person.

6. A safety step fire escape as recited in claim 5, further comprising a C-shaped bar mounted to end of said large leg of said bottom step so that said person can grasp said bar and drop down to said ground level below.

7. A safety step fire escape as recited in claim 6, wherein each said step further comprising a removable adjustable railing to increase safety for said person using said fire escape.

* * * * *